United States Patent [19]

Sutton

[11] Patent Number: 5,072,703

[45] Date of Patent: Dec. 17, 1991

[54] APPARATUS FOR THE AUTOMATIC STARTING RUNNING, AND STOPPING OF AN INTERNAL COMBUSTION ENGINE

[75] Inventor: Loran W. Sutton, East Peoria, Ill.

[73] Assignee: Thermo King Corporation, Minneapolis, Minn.

[21] Appl. No.: 600,406

[22] Filed: Oct. 16, 1990

[51] Int. Cl.[5] ..... F02N 11/08

[52] U.S. Cl. ..... 123/179.4; 307/10.6; 307/10.7

[58] Field of Search ..... 123/179 B, 179 BG, 179 A, 123/179 R; 307/10.6, 10.7

[56] References Cited

U.S. PATENT DOCUMENTS

| | | | |
|---|---|---|---|
| 2,606,298 | 8/1952 | Merritt | 123/179 B |
| 3,926,167 | 12/1975 | Camp | 123/179 BG |
| 4,345,554 | 8/1982 | Hildreth et al. | 123/179 BG |
| 4,421,075 | 12/1983 | Mandel | 123/179 BG |

FOREIGN PATENT DOCUMENTS

| | | | |
|---|---|---|---|
| 58-23250 | 2/1983 | Japan | 123/179 B |
| 58-140434 | 8/1983 | Japan | 123/179 B |
| 58-162748 | 9/1983 | Japan | 123/179 B |
| 58-178845 | 10/1983 | Japan | 123/179 B |
| 1271996 | 11/1986 | U.S.S.R. | 123/179 B |

*Primary Examiner*—Andrew M. Dolinar

[57] ABSTRACT

Apparatus for the automatic starting, running and stopping of an internal combustion engine. Designed primarily for automotive applications, this invention provides significant improvements in convenience, safety, and reliability as compared to current state of the art engine controller designs. Included are means of automatic activation for ease of operation, means of automatic deactivation to insure safety, and means of automatically initiating an engine start sequence or disregarding an engine shutdown request in order to avoid a low probability of restart condition. Means are also provided for the actuation of fuel supply means, actuation of the starter, and actuation of accessories as with any automatic engine starting device.

25 Claims, 1 Drawing Sheet

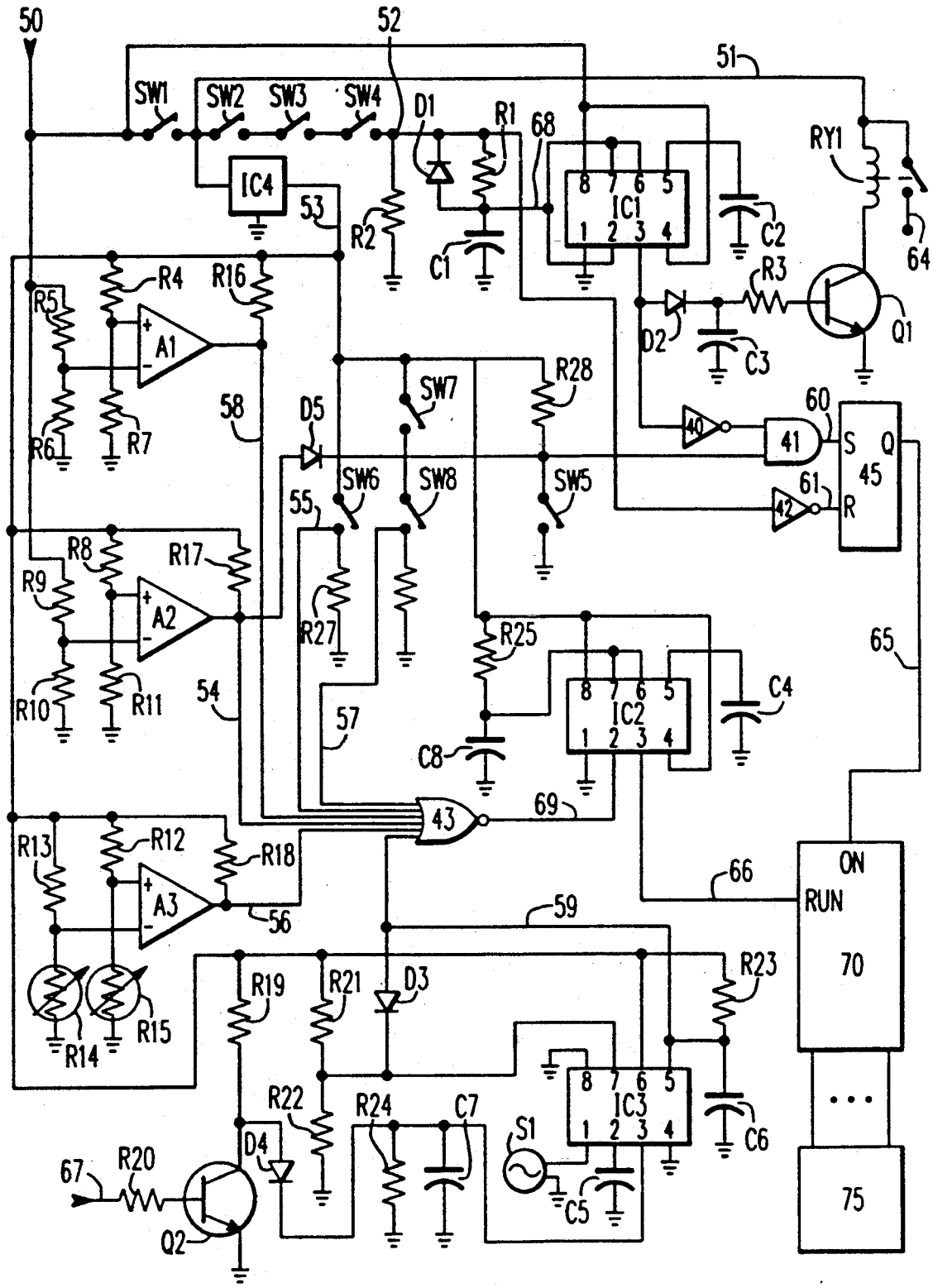
50
52
51
SW1
SW2
SW3
SW4
D1
R1
68
RY1
IC4
53
R2
C1
IC1
C2
64
R3
Q1
R4
R16
R5
A1
D2
C3
R28
SW7
58
D5
60
40
41
S
Q
45
R6
R7
SW6
SW8
SW5
61
42
R
55
R8
R17
R9
A2
R27
R25
65
R10
R11
54
57
IC2
C4
C8
43
69
R13
R12
R18
A3
66
ON
RUN
70
56
59
R19
R21
D3
R23
R14
R15
R22
R24
C7
IC3
C6
S1
D4
67
R20
C5
75
Q2

APPARATUS FOR THE AUTOMATIC STARTING RUNNING, AND STOPPING OF AN INTERNAL COMBUSTION ENGINE

BACKGROUND OF THE INVENTION

1. Field of the Invention

This invention relates to an apparatus for automatically starting, running and stopping an internal combustion engine. More specifically, it relates to an engine controller designed for automotive applications that addresses convenience, safety, and reliability problems inherent in other systems of this nature.

2. Description of the Prior Art

Systems for the automatic starting, running, and stopping of an internal combustion engine have become fairly common in the market place and are used in a variety of applications such as truck refrigeration units, auxiliary electrical power generators, and remote control engine operation. These systems monitor a specific parameter, such as cargo area temperature in the case of refrigerated truck applications, and operate an engine accordingly. Anyone skilled in the art of engine controller design will realize that, for reasons of necessity, automatic engine controllers have in common means for actuating and de-actuating the fuel supply or ignition system, means for engaging the starter until the engine has started, means for stopping an engine if oil pressure or overheat problems develop, and means for activating engine driven accessories once the engine is running. Furthermore, the design of such an engine controller constitutes a relatively trivial task for an engineer versed in the use of electronic timers, electromechanical relays, and engine sensors. Thus, the basic function of automatic engine starting, running, and stopping of an internal combustion engine will be treated as a functional block in the description of this invention.

It is customary to continuously idle a truck engine in long-haul applications in order to maintain a comfortable environmental temperature within the truck sleeper unit when the ambient temperature is not within the comfort range of the driver. This practice lends itself to an ideal application of automatic engine control with the addition of a thermostat within the sleeper. Accordingly, it is an object of this invention to provide an automatic engine starting, running, and stopping system suitable for the desired truck sleeper environmental control application.

One problem associated with automatic engine control systems for trucking applications is the necessity to train drivers in their use. To further compound the problem, many trucking businesses experience a high rate of driver turnover thereby making training a potentially never-ending process. Thus, it is a further object of this invention to provide an automatic engine control system that requires little or no driver training effort.

Another problem associated with automatic engine control systems for trucking applications is the potential for property damage and personal injury. For instance, a vehicle may be automatically started while a mechanic is working on the engine or when the vehicle is in gear. The usual approach to compensate for these liabilities is to employ hood and transmission sensors in order to disable the automatic starting of an engine when the hood is up or the transmission is in gear. While this approach is valid and necessary, it is well-known that the failure mode of any sensor system is not entirely deterministic. Accordingly, it is another object of this invention to provide a fail safe back-up system to accommodate transmission and hood failure mode uncertainties.

Another problem associated with automatic engine control systems for trucking applications is the necessity for reliability since a disabled vehicle results in loss of revenue far exceeding the fuel savings realized by the system. Problems arising that can adversely affect the startability of an engine include: insufficient cranking energy available from the batteries, low ambient temperatures threatening diesel fuel gel, and problems in the starting and charging system. According to the invention, a fail-to-start condition can be avoided by either initiating a start sequence before conditions: become critical or disregarding a shutdown request from the controlling parameter, namely, a truck sleeper unit temperature.

It is well known that when an automotive type battery is discharged and accepting a charge from the engine alternator, the output voltage of the alternator drops in accordance with the amount of charging current supplied to the battery. Thus, it is a further object of this invention to provide means for ignoring a shutdown request from the controlling parameter when the battery is discharged as indicated by a low alternator output voltage level.

It is also well known that the open circuit voltage of a lead-acid type battery is an indication of state of charge. For instance, if 12.6 volts indicates a 100 percent charge, 12.4 volts may indicate a 75 percent charge, and 12.2 volts may indicate a 50 percent charge on a battery. Given that the parasitic loads on an automotive battery are typically very low in current consumption, thereby implying near open circuit conditions, it is a further object of this invention to initiate a start sequence when the vehicle battery state of charge, as indicated by its voltage, falls to 75 percent, for example.

The amount of energy available from a lead-acid type battery can be estimated given battery state of charge and electrolyte temperature. Further, the energy required to crank a given engine at a specified speed is directly related to oil viscosity, a parameter easily estimated with knowledge of oil type and temperature. Experimental data shows that the likelihood of a successful engine start of an operable diesel engine is high when the cranking speed is above a certain critical level, for example, 200 rpm, and very low when the cranking speed is below the critical level. Accordingly, it is a further object for this invention to provide means of estimating the battery energy available using electrolyte temperature sensing means, to provide means for estimating the energy required to crank an engine at a speed sufficiently above the critical level using engine oil temperature sensing means, and to avoid a fail-to-start condition by initiating a start sequence before the estimated energy available from the battery is below the estimated level needed to crank the engine sufficiently faster than the critical speed.

It is a further object of this invention to provide means for measuring cranking speed and to provide means for affectuating or causing a continuous idle condition when the measured cranking speed is near a critical level.

It is also known that diesel fuel has a tendency to gel at low temperatures. The severity of this problem is significantly reduced while an engine is running because agitation generated by engine vibration and fuel recirculation tends to break up gel formations within the fuel delivery system before their size becomes large enough to restrict fuel flow. Thus, it is a further object of this invention to provide means for initiating a start sequence and ignoring a shutdown request from the controlling parameter when the ambient temperature threatens fuel gel.

SUMMARY OF THE INVENTION

Briefly, the present invention includes apparatus for maintaining a comfortable truck sleeper unit temperature, while reducing idle time. The apparatus includes temperature sensing means disposed within the truck sleeper unit, means for starting, running, and stopping a truck engine in accordance with the temperature sensing means, thereby supplying heating or cooling to the truck sleeper unit only as needed. The apparatus further includes means for detecting when the truck is safely parked and idling, and means for automatically enabling the truck engine starting means after the means for detecting when the truck is safely parked and idling indicates the truck has been safely parked and idling for a predetermined amount of time. The apparatus also includes means for automatically disabling the starting, running, and stopping means in response to predetermined conditions.

BRIEF DESCRIPTION OF THE DRAWING

The invention will become more apparent by reading the following detailed description in conjunction with the drawing, which is shown by way of example only, wherein the single Figure is a schematic diagram of apparatus constructed according to the teachings of the invention, for controlling the automatic starting, running, and stopping of an internal combustion engine, suitable for truck sleeper environment control.

DESCRIPTION OF PREFERRED EMBODIMENTS

One embodiment of the invention will now be described by way of example, with reference to the electrical circuit schematic shown in the FIGURE, of an apparatus for controlling a basic automatic engine starting, running, and stopping device in a manner suitable for the truck sleeper environmental control application.

Referring to the drawing, element 70 is a functional block comprising a basic automatic engine starting device responsible for actuation of fuel supply or ignition means, starter motor, and electrical accessories in accordance with the input labeled RUN. When activated by a positive voltage signal on the ON input, block 70 is to start and run the engine represented by block 75 when a positive voltage is present on line 65 and shut down engine 75 when voltage is not present.

Line 50 is connected to the vehicle battery positive terminal and is the electrical power supply for the vehicle and circuitry herein. SW1 is the vehicle key switch that normally supplies power to the vehicle electrical system. Instead, the output of SW1 on line 51 is fed to the vehicle electrical system through a relay RY1 on line 64 for reasons that will become clear later. A chain of switches, comprising neutral switch SW2, hood switch SW3, and parking brake switch SW4, closes when the vehicle transmission is in neutral, the hood down, and the parking brake is applied, thereby generating a voltage on line 52 when the vehicle is safely parked and the vehicle key switch is on.

Electronic timer IC1 has eight terminals labeled 1 to 8. Terminals 2 and 6 are tied together and connected by line 68 to the junction of resistor R1 and capacitor. C1, the values of which determine the timing interval duration. Terminals 8 and 4 are connected to the voltage supply of line 50, terminal 1 is grounded, and terminal 7 is unused. Output terminal 3 of IC1 produces a positive output voltage through diode D2 and resistor R3 to supply current to the base of a transistor Q1 which in turn actuates relay RY1, thereby supplying a voltage on line 64 when the vehicle key switch SW1 is on and the charge level on capacitor C1 is below the level defined at pin 5 of IC1. Thus, when the voltage on line 52 indicates that the vehicle is safely parked and idling, capacitor C1 charges through resistor R1. After 4 minutes, for example, capacitor C1 is charged to the level defined at pin 5, at which point the output pin 3 of IC1 goes low and cuts off the base drive current for Q1, thereby cutting off the current path for the coil of RY1. If any one of the switches S1–S4 opens prior to the completion of the timing interval of IC1, charge accumulated on capacitor C1 is discharged through diode D1 and resistor R2, thereby resetting timer IC1 to time zero.

At this point it is clear that the functional operation of the vehicle electrical system behaves as follows: while the ignition key SW1 is in the on position and the brake is not set, capacitor C1 is held discharged and the output of IC1 is high, thereby turning on transistor Q1 which, in turn, actuates relay RY1, thus supplying voltage to line 64 to run the vehicle. Once the vehicle is parked with the engine kept running, a voltage appears on line 52 that charges timing capacitor C1, thereby timing out IC1, turning off transistor Q1, and de-actuating relay RY1.

Element 41 is a logical "and" gate with two inputs. One input is connected to oil pressure switch SW5 that closes when oil pressure is low, having one terminal grounded and the other connected to voltage supply line 53 through resistor R28. Thus, the oil pressure signal present at "and" gate 41 input indicates high oil pressure by a positive voltage signal, a logical "1", and low oil pressure by a ground potential, a logical "0". The other input of "and" gate 41 is connected to the output pin 3 of IC1 through logical inverter element 40. Appearing at the output of "and" element 41 is a logical "1" when the output of IC1 is low and oil pressure is high. The output of element 41 is connected to the "set" terminal of element 45, a set/reset latch. The "reset" terminal of element 45 is connected to the switch chain comprising SW1–SW4 through inverter element 42. Thus, the "Q" output of element 45 is set to a logical "1" only when the vehicle is running at high oil pressure with switch chain SW1–SW4 closed when timer IC1 times out. Any time the switch chain SW1–SW4 is opened, element 45 is reset to a logical "0" at the "Q" output. It is a logical "1" at the output of set/reset latch that enables automatic engine controller block 70 at line 65 and a logical "0" that disables block 70.

The above sub-system, comprising switches SW1–SW5, IC1, elements 40, 41, 42, and the associated circuitry, constitutes the automatic activation/deactivation circuit, it requiring little training to operate the fail-safe safety circuit. Considering the automatic activation/deactivation circuit, it is clear that the vehicle operator who parks in a normal manner with the intent to idle will have no trouble activating the system. To deactivate, all the driver need know is how to turn the vehicle key off, release the parking brake, or put the transmission in gear. The fail-safe aspect of this circuit results from employing neutral, parking brake, and hood sensors having a most likely failure mode that gives an unsafe indication, thereby not allowing activation of automatic engine controller block 70, and by requiring the vehicle to idle for the IC1 timing period before block 70 is activated. The reasoning behind the mandatory initial idle period is that a vehicle that has idled for several minutes, according to switches SW1-SW5, is very likely in neutral with the hood down and the brake set. This is not the case if the vehicle is parked and not idling, as many drivers place the transmission in gear instead of using the parking brake. Oil pressure switch SW5 used for this circuit is made fail-safe by utilizing it as a starter lock out signal, under high oil pressure conditions, in block 70. Thus, a failed oil pressure switch falsely indicating high pressure, thereby enabling the activation of block 70 without actually completing the mandatory initial idle interval, would result in a no-start condition.

Once the initial idle period of IC1 is complete and engine controller block 70 is enabled by latch element 45, the engine will continue to run if any one of the following conditions are present: low alternator output voltage, low ambient temperature, low predicted cranking speed, or a sleeper unit temperature outside the comfort range when environmental control mode is enabled. Capacitor C3 is provided to temporarily maintain energization of relay RY1 during the changeover period from running the engine from voltage on line 64 to running on engine controller 70. Otherwise, the engine will be shut off to await a start sequence command.

Low alternator output is detected by amplifier A2 by comparing the vehicle system voltage on line 50 at a voltage divider comprising resistors R9 and R10 to the regulated voltage provided by voltage regulator IC4 on line 53 at reference voltage divider comprising resistors R8 and R11. When the vehicle system voltage is below the threshold defined by resistors R8 and R11, the output of amplifier A2 open circuits, thereby generating a positive voltage signal on line 54 through resistor R17. The anode of a diode D5 is connected to line 54 and the cathode is connected to oil pressure switch SW5 to disable the low alternator output circuit when the engine is not running.

Low ambient temperatures that threaten fuel gel are detected by bimetallic switch SW6 that close when the temperature is below 10 degrees Fahrenheit, for example, thereby generating a positive voltage on line 55.

A low predicted cranking speed condition is detected by amplifier A3, wherein the voltage at a voltage divider comprising resistors R12 and R15, R15 being a thermistor with a negative temperature coefficient immersed in the engine lubricating oil, is compared to the voltage at a voltage divider comprising resistors R13 and R14, R14 being a thermistor with a positive temperature coefficient attached to the vehicle battery. The temperature coefficients of thermistors R14 and R15 are such that the output of amplifier A3 goes high, thereby generating a positive voltage on line 56 when the predicted cranking speed based on battery and engine oil temperature falls below a minimum level.

Truck sleeper unit environmental control is enabled by the closure of switch SW7 thus supplying voltage to switch SW8, a bimetallic thermostat switch similar to those for home furnace control. Switch SW8 closes to indicate the sleeper is outside the comfort range and supplies voltage to line 57, thereby indicating an engine run condition.

Engine run signal lines 54, 55, 56, 57 are inputs to logic element 43, a logical "nor" gate. Thus, a logical "1" at any of the inputs of element 43 generate a logical "0" at the output. The output of "nor" gate 43 is connected to trigger pin 2 of IC2, an electronic timer. A logical "0" trigger signal initiates a timing cycle, wherein output pin 3 of IC2 goes high for the time period determined by the values of resistor R25 and capacitor C8. A characteristic of electronic timer IC2 is that, if the trigger pin 2 remains at a logical "0" when the timing interval is complete, the output pin 3 signal remains at a logical "1" until the trigger pin 2 receives a logical "1". Output pin 3 of IC2 drives the RUN input of engine controller block 70, wherein a logical "1" prompts an engine run sequence and a logical "0" prompts an engine shutdown.

At this point it is clear that the functional operation of the described system is as follows: upon completion of the initial idle period, engine controller block 70 is activated by set/reset latch element 45. If low alternator output, or low ambient temperature, or low predicted cranking speed, or low cabin comfort condition is detected, the engine will continue to run on engine controller block 70 for the time duration of timer IC2, for example, 20 minutes, and until the condition no longer exists. Otherwise, the engine will be turned off to await a restart request at the output of electronic timer IC2 output pin 3.

Also connected to the input of "nor" gate element 43 is the low battery voltage level detection circuitry comprising amplifier A1 and voltage dividers comprising resistors R5/R6 and R4/R7, wherein the vehicle electrical system voltage at divider R5/R6 is compared to a regulated reference voltage at divider R4/R7. When the vehicle electrical system voltage drops below a fixed point, for example, 12.4 volts indicating a 75 percent charge, amplifier A1 output on line 58 goes high thereby generating a start request at trigger pin 2 of IC2. Note that this circuit is identical to the low alternator detection circuitry with the exception of diode D5 at the output of amplifier A2, whereby low alternator output voltage detection is disabled when the engine is not running.

Also connected to the input of "nor" gate element 43 at line 59 is the low measured cranking speed latch circuitry comprising frequency to voltage converter IC3 and associated circuitry. Pin 1 of IC3 is connected to a variable reluctance speed sensor S1 that generates a frequency signal in proportion to engine rpm. Output pin 3 of IC3 generates a voltage indicating engine rpm with a constant of proportionality determined by the product of resistor R24 and capacitor C5 values. Also connected to pin 3 of IC3 is diode D4 which injects a false rpm voltage level indicating a cranking rpm higher than the critical level established by the regulated reference voltage at a voltage divider comprising resistors R21/R22 when the starter motor is not engaged. Line 67 is connected to the starter motor, thereby supplying base drive current to transistor Q2 through resistor R20 to turn off false rpm signal injection when the starter is engaged. Capacitor C7 is provided at pin 3 of IC3 to momentarily store the false rpm signal supplied by resistor R19 and diode D4 to reject the initial starter rpm measurements to allow the starter motor to accelerate to full cranking speed before a low cranking speed condition can be detected. Output pin 5 of IC3 at line 59 generates a logical "1" voltage when the rpm voltage at pin 3 falls below the threshold rpm voltage at pin 7, defined by a voltage divider R21/R22. Diode D3 anode is connected to output pin 5 to feed a logical "1" signal, indicating a low cranking rpm detection event, onto the reference rpm voltage level at pin 7 in order to latch the output signal at pin 5 high when a low cranking speed event is detected, thereby providing or causing a continuous idle condition. Capacitor C6 is connected to output pin 5 in order to initialize the output of IC3 to a logical "0" when the regulated voltage at line 53 is turned on by closure of truck key switch SW1.

At this point it is clear that the invention described herein functions as follows: upon the closure of switches SW1-SW4 while the engine is running, timer IC1 begins to clock. If the engine continues to run for the duration of the IC1 timing interval, automatic engine controller block 70 is activated. At this point, the engine will continue to run only if one or more of the following conditions exist: low alternator output voltage, low ambient temperatures threatening fuel gel, low predicted cranking speed, or, if environmental control mode is activated, a low truck sleeper unit comfort level. When all conditions causing the engine to run have become satisfied and the engine has idled at least the duration of timer IC2, the engine will shut down to await a restart upon any of the following conditions: low truck sleeper unit comfort level, low battery voltage level, low predicted cranking speed, or low ambient temperatures. When restarted, the engine will again idle to satisfy all "run" conditions under timer IC2 control, and shut down to await another "run" condition. If the cranking speed of the starter motor is low during any engine restart under block 70, a "run" condition is generated that can only be satisfied by deactivating block 70.

What is claimed is:

1. An apparatus for maintaining a comfortable truck sleeper unit temperature of a truck having a truck engine, and reducing idling time of the truck engine, comprising:

temperature sensing means within said truck sleeper unit, means for starting, running and stopping the truck engine in accordance with said temperature sensing means thereby supplying heating or cooling only as needed, means for detecting when said truck is safely parked and idling, means for automatically enabling said starting means after said means for detecting when said truck is safely parked and idling indicates said truck has been safely parked and idling for a predetermined amount of time, and means for automatically disabling said starting, running, and stopping means.

2. The apparatus of claim 1, wherein said means detecting when said truck is safely parked and idling comprises a parking brake switch, a neutral switch, a hood switch, an oil pressure switch, and a truck ignition switch.

3. The apparatus of claim 2 wherein said oil pressure switch is used for starter lock out purposes.

4. The apparatus of claim 2 wherein said temperature sensing means within said sleeper unit is an adjustable thermostat.

5. The apparatus of claim 1 wherein the truck includes a battery, and including means for detecting when the battery voltage level is below a predetermined value, and including means for initiating an engine start sequence in response to the battery voltage level being below said predetermined value.

6. The apparatus of claim 1 including ambient temperature sensing means, and means for initiating an engine start sequence in response to predetermined ambient temperatures.

7. The apparatus of claim 6 wherein the ambient temperature sensing means is a bimetallic temperature switch.

8. The apparatus of claim 1 including means for predicting when the engine cranking speed will be below a predetermined value, and means responsive to said predicting means for initiating an engine start sequence in response to the predicted cranking speed being below said predetermined value.

9. The apparatus of claim 8 wherein the means for predicting engine cranking speed includes battery energy estimation means and cranking energy requirement estimation means.

10. The apparatus of claim 9 wherein said battery energy estimation means includes battery electrolyte temperature sensing means.

11. The apparatus of claim 9 wherein said cranking energy requirement estimation means includes engine lubricating oil temperature sensing means.

12. The apparatus of claim 1 wherein the truck includes a battery, and including means for detecting when the battery voltage level is below a predetermined value, and means responsive to said detecting means for providing a continuous idle condition in response to the battery voltage level being below said predetermined value.

13. The apparatus of claim 12 wherein the means for detecting battery voltage level comprises truck electrical system voltage monitoring means.

14. The apparatus of claim 1 including ambient temperature sensing means, and means for providing a continuous idle condition in response to predetermined ambient temperatures.

15. The apparatus of claim 14 wherein the ambient temperature sensing means is a bimetallic switch.

16. The apparatus of claim 1 including means for predicting when engine cranking speed will be below a predetermined value, and means responsive to said predicting means for providing a continuous idle condition when the predicted cranking speed is below said predetermined value.

17. The apparatus of claim 16 wherein the means for predicting cranking speed includes battery energy estimation means and cranking energy requirement estimation means.

18. The apparatus of claim 1 including means for detecting when the engine cranking speed is below a predetermined value, and means responsive to said detecting means for providing a continuous idle condition when the cranking speed is below said predetermined value.

19. The apparatus of claim 1 including means for running the truck engine for a predetermined minimum period of time when the means for starting, running, and stopping the truck engine starts the engine.

20. The apparatus of claim 1, wherein the means for detecting when the truck is safely parked and idling includes a parking brake switch.

21. The apparatus of claim 1 wherein the means for detecting when the truck is safely parked and idling includes a neutral switch.

22. The apparatus of claim 1 wherein the means for detecting when the truck is safely parked and idling includes a hood switch.

23. The apparatus of claim 1 wherein the means for detecting when the truck is safely parked and idling includes an oil pressure switch.

24. The apparatus of claim 1 wherein the means for detecting when the truck is safely parked and idling includes a truck ignition switch.

25. The apparatus of claim 1 wherein the truck includes a battery, and including means for predicting engine cranking speed as a function of engine and battery temperatures, with said predicting means initiating an engine start sequence, when the engine is stopped, and maintaining engine idle, when it is running, when the predicting means predicts a cranking speed below a predetermined value.

* * * * *